United States Patent [19]

Carlson

[11] Patent Number: 5,056,229

[45] Date of Patent: Oct. 15, 1991

[54] SAIL PLOTTER

[76] Inventor: Gregory H. Carlson, 1801 N. 170th E. Ave., Tulsa, Okla. 74116

[21] Appl. No.: 304,483

[22] Filed: Feb. 1, 1989

[51] Int. Cl.[5] ..... B43L 13/00

[52] U.S. Cl. ..... 33/23.03; 33/1 M; 33/18.1; 33/32.1; 33/445

[58] Field of Search ..... 33/23.07, 23.03, 23.01, 33/23.11, 18 R, 1 M, 32.1, 32.2, 443, 445

[56] References Cited

U.S. PATENT DOCUMENTS

| | | | |
|---|---|---|---|
| 977,829 | 12/1910 | Ourdan | 33/32.1 |
| 2,219,783 | 10/1940 | Matson | 33/26 |
| 2,252,535 | 8/1941 | West et al. | 33/445 |
| 3,550,276 | 12/1970 | Kramer et al. | 33/23.03 X |
| 4,426,783 | 1/1984 | Gerber et al. | 33/32.1 X |
| 4,709,483 | 12/1987 | Hembree et al. | 33/18.1 |
| 4,777,727 | 10/1988 | Lawrence | 33/18.1 |
| 4,779,348 | 10/1988 | Levy | 33/23.03 |

*Primary Examiner*—Harry N. Haroian
*Attorney, Agent, or Firm*—William S. Dorman

[57] ABSTRACT

A device for marking lines on a piece of sail cloth for cutting out sections therefrom for making a sail, comprising an elongated and horizontally extending table for supporting a length of sail cloth thereon and being wider than the width of the sail cloth, a continuous strip of gearbelt material extending along each side edge of the table whereby the strips of gearbelt material are parallel to each other and to the longitudinal axis of the table, each strip of gearbelt material being pliant and being provided with internal reinforcements to prevent substantial longitudinal stretching thereof, the upper portion of each strip of gearbelt material being provided with uniformly spaced gear teeth for the length of each strip. A longitudinally moveable carriage is mounted on the table, and a transverse rotatable shift is mounted in the carriage. A pair of gears are attached to the ends of the shaft for rotation therewith, each gear being adapted to mesh with a gearbelt strip such that a substantial portion of the weight of the carriage is exerted against the gearbelt strips through the gears.

5 Claims, 7 Drawing Sheets

SAIL PLOTTER

BACKGROUND OF THE INVENTION

1. Field of the Invention

This invention relates to a device for marking lines on a piece of sail cloth for cutting out sections thereof to make a sail. More particularly, this invention involves an improved mechanism for moving up and down the table on which the sail cloth is positioned.

2. The Prior Art

Large sails for sailing craft are fabricated by assembling a plurality of smaller panels. Such panels usually are of triangular configuration and of various sizes. The sail maker works with bolts of fabric, and a single panel may have a length of many yards. Therefore, there has been a need for a plotting device able to handle large rolls of cloth and apply pattern designs thereto extending over a substantial continuous distance. Heretofore, no efficient mechanism has been available for accomplishing such large scale pattern layouts.

Several large scale X-Y plotting tables have been proposed for the above purposes. However, most of these proposed plotting tables are deficient from a standpoint of accuracy, simplicity and speed of operation.

A patentability search was conducted on the present invention and the following U.S. patents were uncovered in this search:

| U.S. Pat. No. | Patentee | Date |
|---|---|---|
| 4,593,469 | Shoup, II | 6-10-86 |
| 3,850,043 | Tarbox | 11-26-74 |
| 4,328,726 | Pearl | 5-11-82 |
| 3,844,461 | Robison et al. | 10-29-74 |
| 3,473,157 | C. H. Little et al | 10-14-69 |
| 4,555,851 | Levy | 12-03-85 |
| 4,665,619 | Pearl | 5-19-87 |
| 3,744,891 | Dennis et al. | 7-10-73 |
| 4,270,404 | Murakoshi et al. | 6-02-81 |

None of these above patents is deemed sufficiently close to the present invention to require any comment.

SUMMARY OF THE INVENTION

The present invention involves a device for marking lines on a piece of sail cloth for cutting out sections for making a sail. The marking device includes an elongated and horizontally extending table which supports a length of sail cloth thereon. The table is wider than the width of the sail cloth. A continuous strip of gearbelt material extends along each side edge of the table whereby the strips of gearbelt material are parallel to each other and to the longitudinal axis of the table. Each strip of gearbelt material is pliant and is provided with internal reinforcements to prevent substantial longitudinal stretching thereof, the upper portion of each strip of gearbelt material being provided with uniformly spaced gear teeth for the length of each strip. A transverse rotatable shaft is mounted in the movable carriage and a pair of gears are mounted adjacent the ends of the shaft for rotation therewith, each gear being adapted to mesh with a gearbelt strip such that a substantial portion of the weight of the carriage is exerted against the gearbelt strips through the gears. An "X" axis motor is mounted on the carriage for rotating the shaft in response to a first series of signals received from a sail plotting program whereby the carriage can be positioned at a precise position along the length of the table. A stylus mounting means is supported on the carriage for transverse sliding movement across the width of the sail cloth. A "Y" axis motor is mounted on the carriage and is responsive to a second series of signals from the sail plotting program to move the stylus mounting means transversely along the carriage so as to position the stylus mounting means in a precise transverse position. A stylus is carried by the stylus mounting means and is adapted to bear against the upper surface of the sail cloth. A stylus control means is operatively associated with the stylus for lifting and lowering the stylus in relation to the sail cloth in response to a third series of signals from the sail plotting program.

DETAILED DESCRIPTION OF THE PREFERRED EMBODIMENTS

Figure 1:
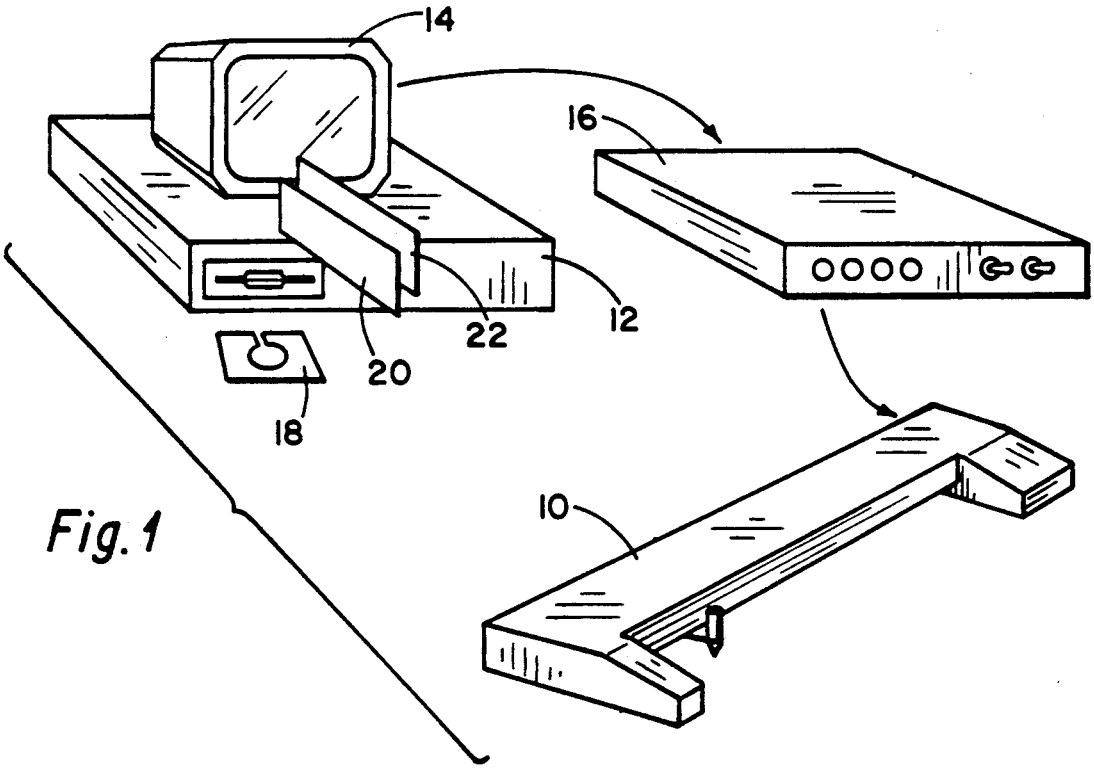
FIG. 1 is a semi-diagrammatic perspective view of a computer, a power and control unit and the carriage which is part of the sail plotter of the present invention.

Referring to the drawings in detail, FIG. 1 shows an essentially conventional control system represented diagrammatically in combination with a carriage 10, which is a portion of the present invention. The overall system in FIG. 1 includes a computer 12 with associated CRT unit 14 and a power control unit 16 which takes commands (or signals) from the computer 12 and supplies power to the carriage 10 to move the carriage in respect to whatever program is installed in the computer. Purely for purposes of illustration, there is shown a floppy disk 18 which contains the necessary software for creating a nesting type of plot for the creation of a sail. The disk 18 can be inserted into the drive for the computer 12, and two cards or circuit boards 20 and 22 for controlling the X and Y axes, respectively, can be inserted internally into the computer 12. The details of the programs and circuits on the disk 18 and the cards 20 and 22 form no part of the present invention, nor does the power and control unit 16.

Figure 2:
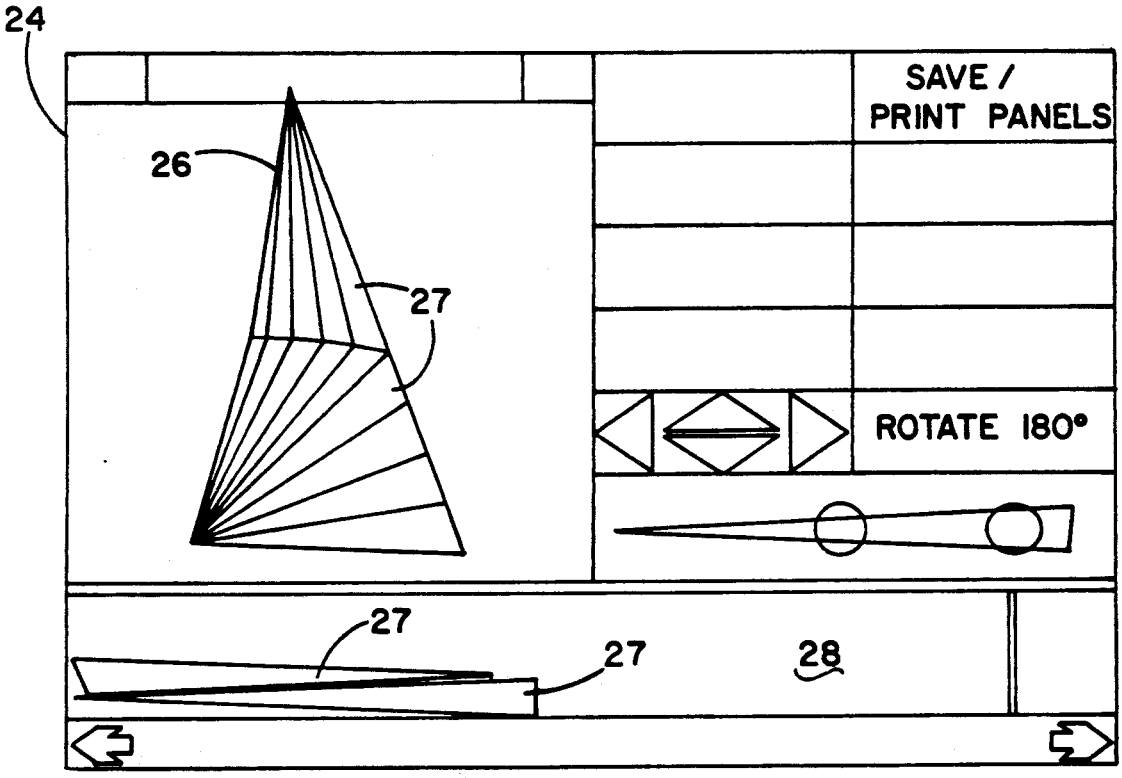
FIG. 2 is a front elevation of a typical pattern produced on the screen of the computer shown on FIG. 1.

With respect to FIG. 2, this represents a picture or design 24 which would appear on the screen of the CRT unit 14 when the appropriate software program is actuated. The design 26 is a diminutive representation of the entire sail to be produced, and the individual triangular elements 27 thereof represent the triangular portions to be plotted on the table to be described hereinafter. The lower portion or field 28 of the picture 24 represents the sail cloth (later to be described) and elements 27 represent individual triangular portions removed from the design 26 and positioned on the field 28 to allow for an economic disposition of the sail elements on the sail cloth. Again, the details of the program are not important as far as the present invention is concerned. Suffice it to say, however, that the program is designed to move the carriage 10 in accordance with the layout of the sail section 27 on the field 28.

Figure 3:
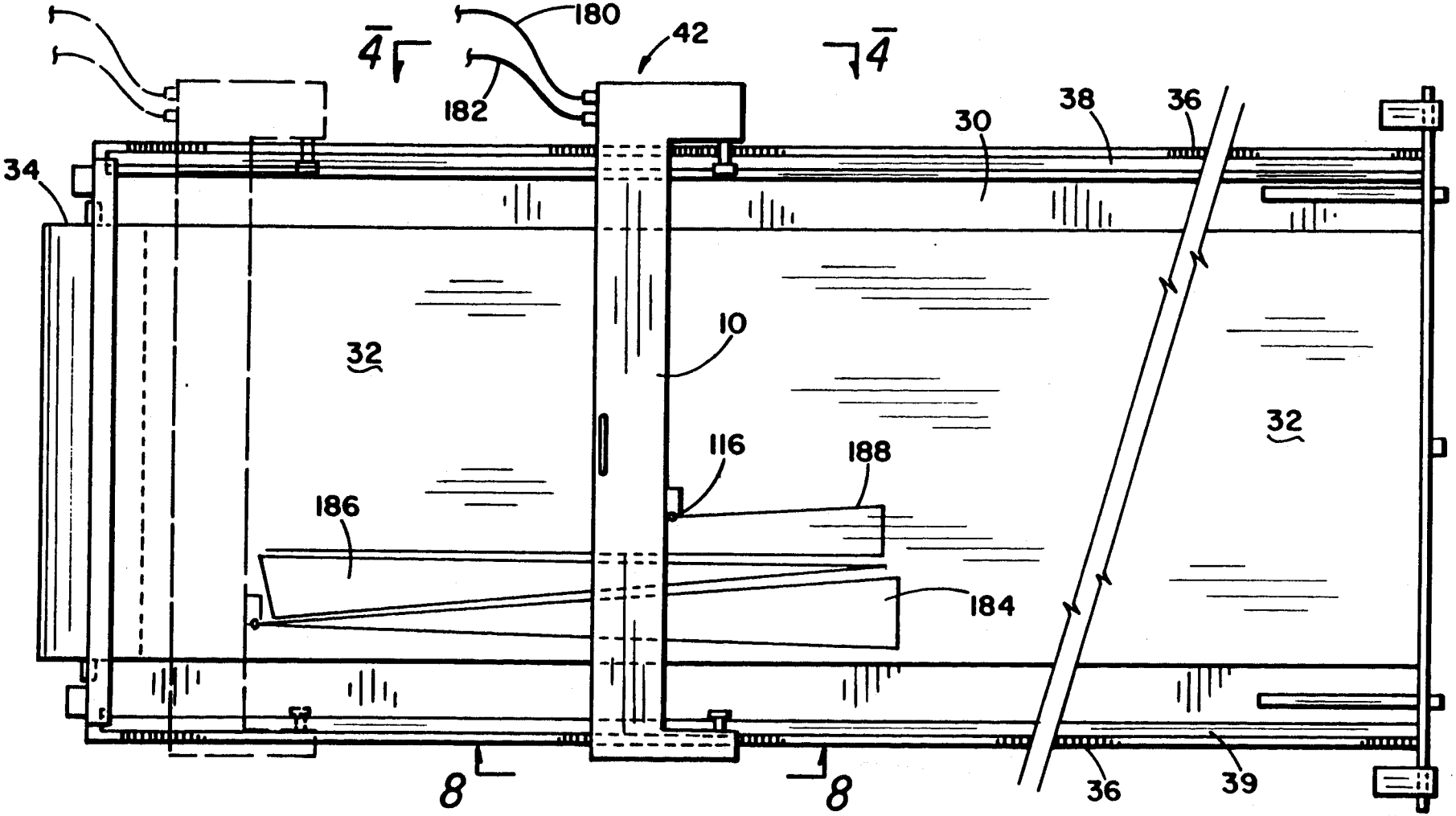
FIG. 3 is a plan view of a portion of a plotting table showing the movable carriage of the present invention mounted thereon and showing a second position of the carriage in dotted lines.
Figure 4:
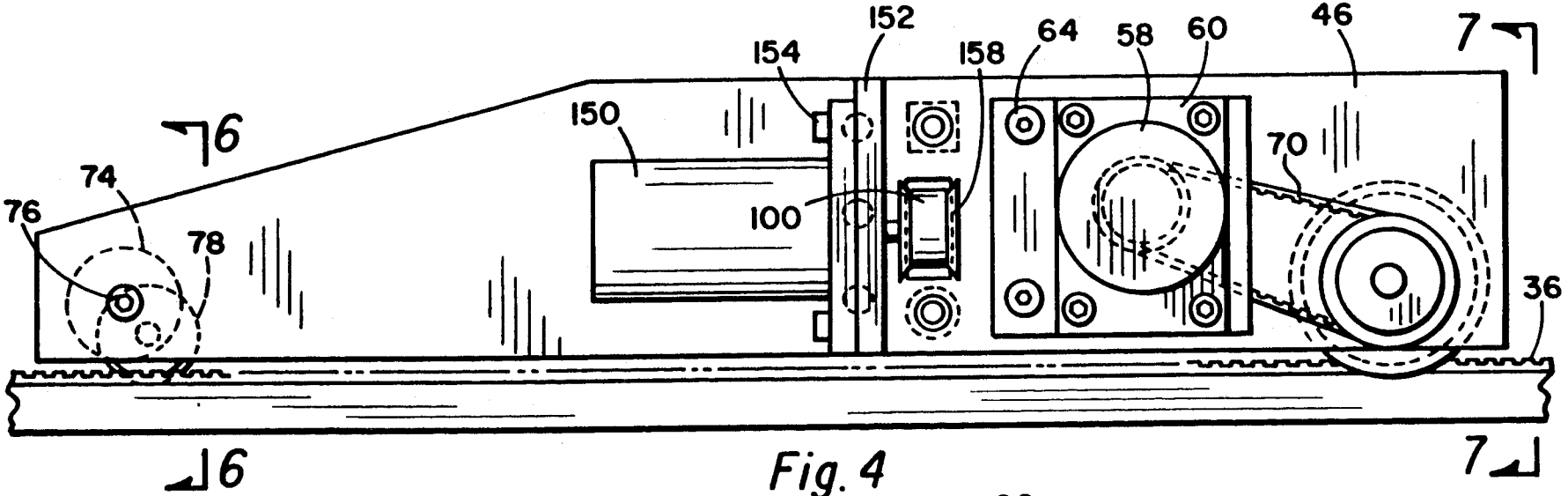
FIG. 4 is a side elevation of the upper end of the carriage shown in FIG. 3, taken along line 4—4 of FIG. 3 and on an enlarged scale.
Figure 7:
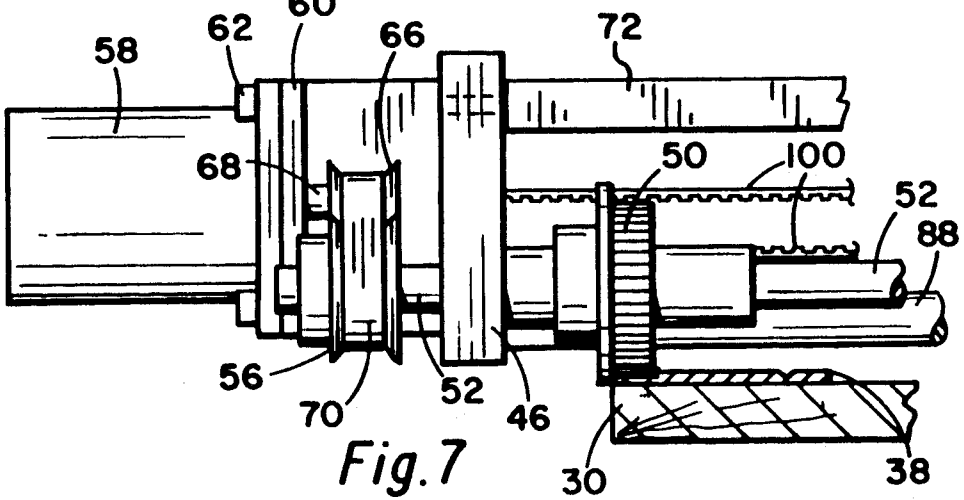
FIG. 7 is an elevation taken along line 7—7 of FIG. 4.

Turning now to FIGS. 3 and 4, the present invention includes the moveable carriage 10 which is slideably mounted for movement towards the right and towards the left along a table 30 which can be up to 50 feet in length or longer. A piece of sail cloth 32 is adapted to lie flat along the surface of the table 30 for the entire length thereof. The cloth 32 can be pulled onto the table from a roll 34 of sail cloth rotatably mounted at the left hand end of the table 30.

An important feature of the present invention involves the provision of a continuous piece or strip of gearbelt material 36 which is secured along either side edge of the table for the length thereof. The strips are parallel to each other and to the "X" axis, which will be more clearly defined hereinafter. The gearbelt material is of the type which can be used for making continuous gearbelts of any desired length by cutting a suitable length of material and securing the ends together in proper fashion so that the resulting belt can be placed around two or more gears to place them in driving relation with each other; of course, the gearbelt can also be purchased in the form of loops of predetermined sizes. The gearbelt material is available in extended lengths for people who wish to make their own gearbelts (of non-standard loop size). The gearbelt material 36 employed herein can be purchased from Pirelli in Milan, Italy, or from other suppliers of similar material. The gearbelt material is generally considered to be extruded neoprene with uniformly spaced gear teeth imprinted into it and provided with Kevlar reinforcing strands. It could also be made of polyurethane, rubber or other suitable material.

Figure 6:
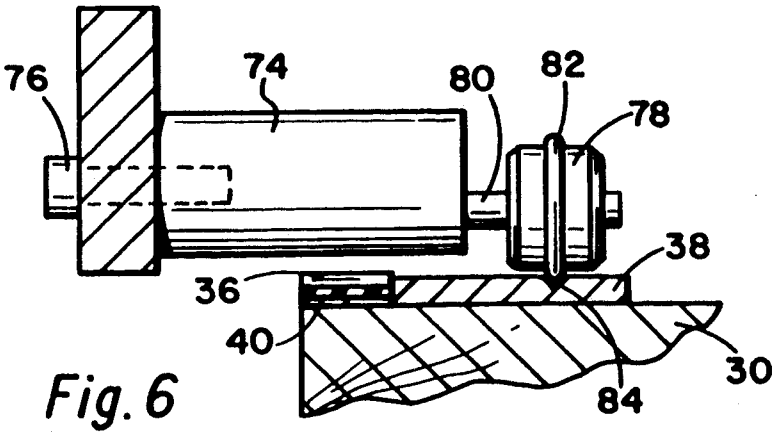
FIG. 6 is a sectional view taken along line 6—6 of FIG. 4.

In any event, the gearbelt is attached to the table 30 over aluminum strips 38 and 39 which are attached to the table 30 in six foot sections along the side edges. The aluminum strips 38 and 39 are placed in end-to-end relation and secured to the table 30 by means of screws (not shown). The outboard edge of each strip 38 and 39 is provided with a recess 40, as shown in FIG. 6, in which the strip 36 is adapted to lie. The lower edge of each strip 36 is secured in the groove 40 by means of double-stick tape (not shown) which is interposed between the bottom of the belt 36 and the top of the groove 40. Both strips 36 are taken from the same continuous roll of gearbelt material to assure uniformity.

Figure 9:
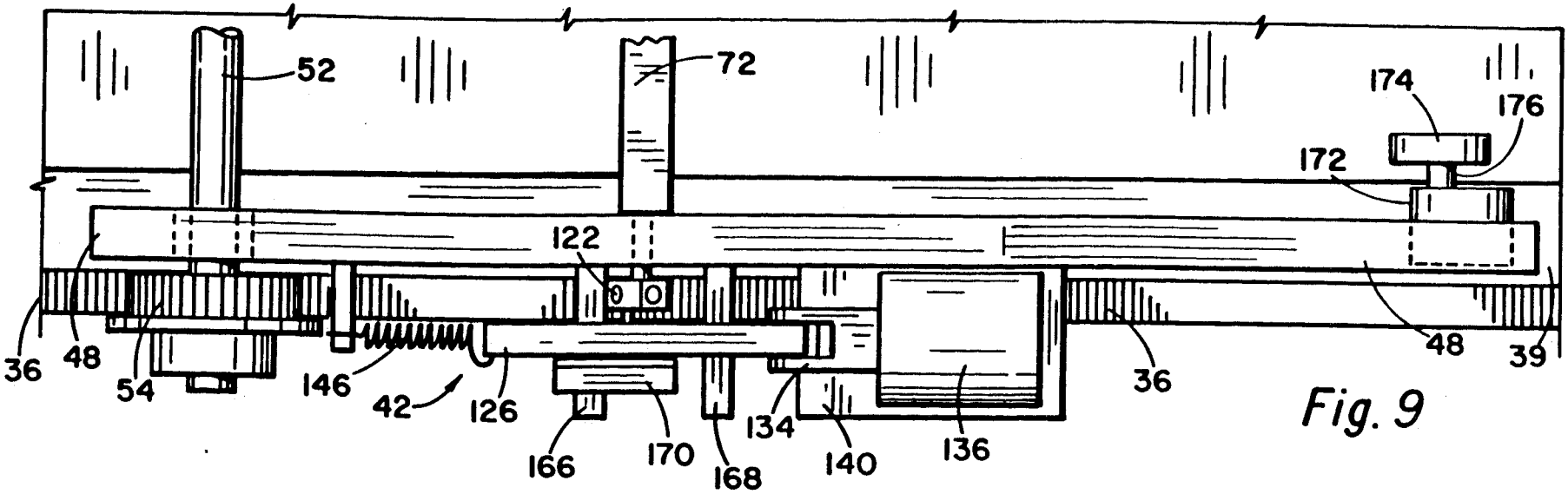
FIG. 9 is a plan view of the components shown in FIG. 8 with the cover removed.
Figure 8:
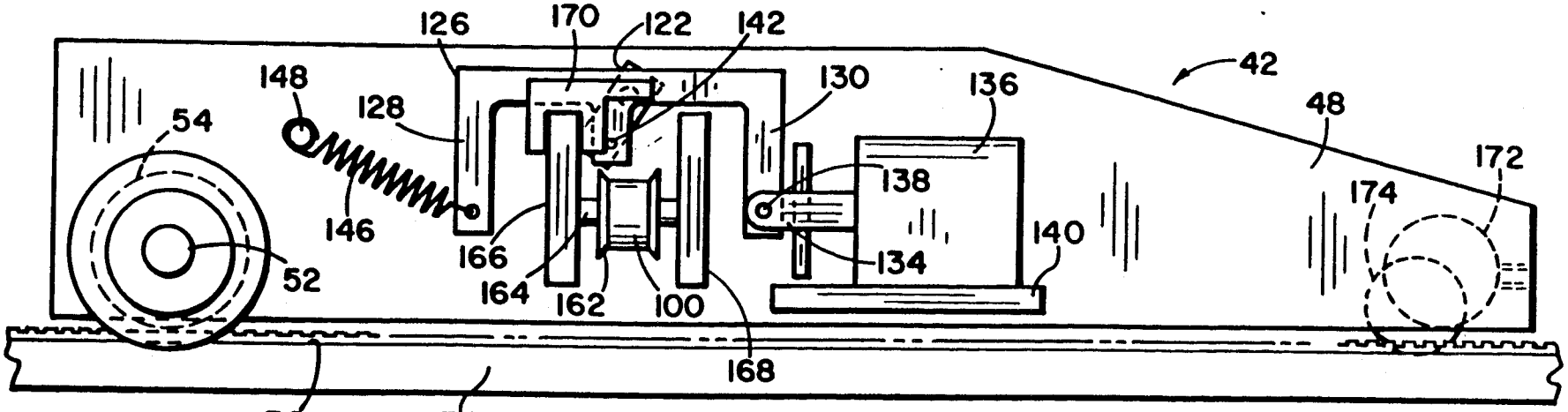
FIG. 8 is a front elevation view, on an enlarged scale, of the lower end of the carriage, taken along line 8—8 of FIG. 3.

For the sake of convenience, the upper end 42 of the carriage 10, as shown in FIG. 3 and as shown in FIGS. 4–7, will be referred to as the "drive" side of the carriage. The lower side 44, shown in FIG. 3 and as also shown in FIGS. 8 and 9, will be referred to as the "passive" side of the carriage, even though the passive side does include the mechanism for lifting and lowering the pen as further shown in FIGS. 10–15.

Figure 5:
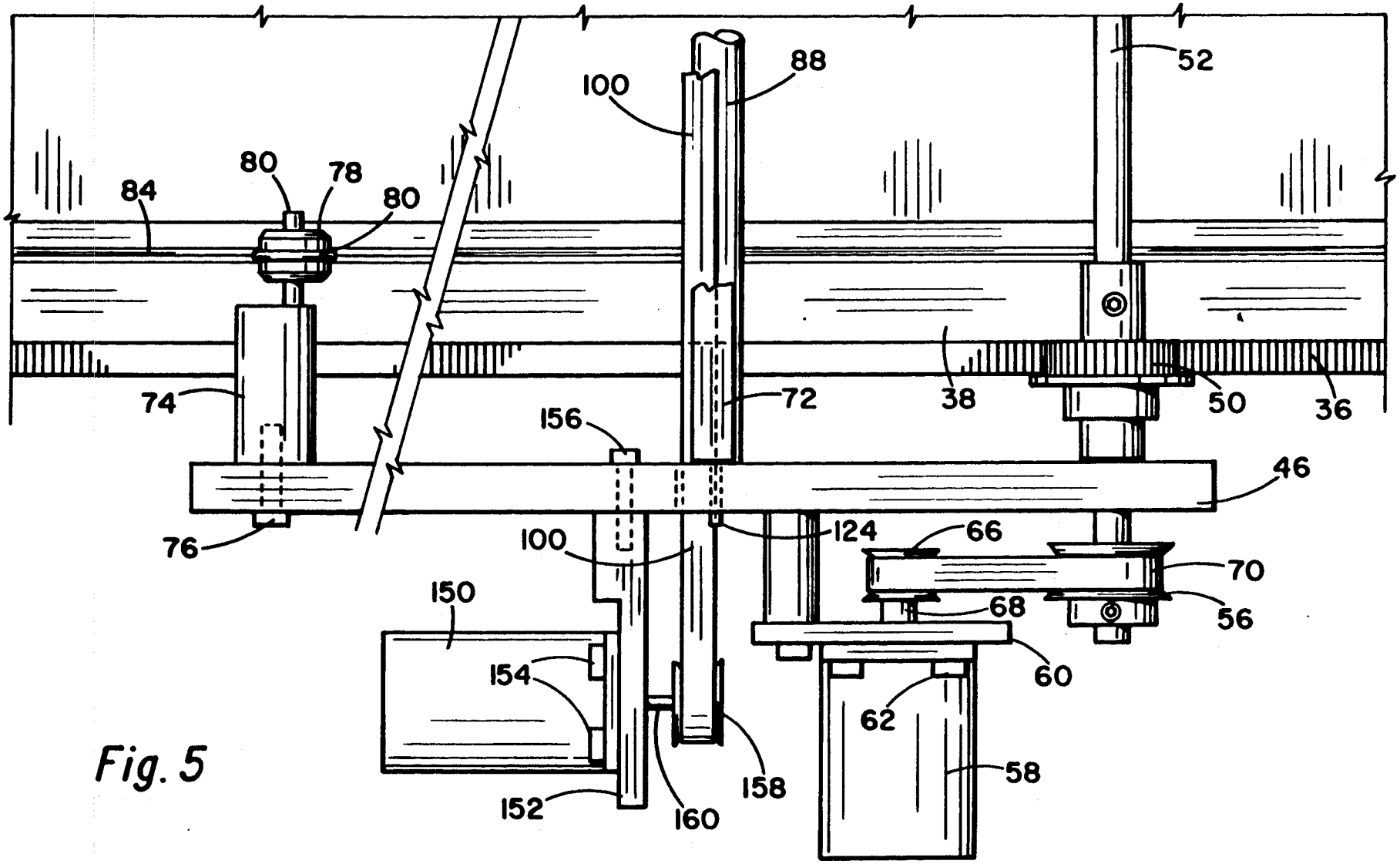
FIG. 5 is a plan view of the components shown in FIG. 4 with the cover removed.

The carriage 10, as shown in FIG. 5, includes a side member 46 along the drive side and a side member 48 along the passive side. A gearbelt pulley (gear) 50 is mounted on a shaft 52 at the drive side of the carriage 10 so as to mesh with the gearbelt section 36 along the drive side of the carriage 10. A second gearbelt pulley 54 is secured to the other end of the shaft 52 so as to ride along the section 36 of gearbelt material at the passive side of the carriage 10. It should be understood that the gear 50 is also secured to the shaft 52 so that both gears 50 and 54 rotate in unison when the shaft 50 rotates. However, one or both of the gears 50 and 54 will be keyed to the shaft 52 by means of a set screw so that one gear 50 can be turned relative to the other gear 54 to provide a proper initial setting of the drive for the carriage 10. The shaft 52 is suitably journaled in the side members 46 and 48.

A gear pulley 56 is secured to the outer end of the shaft 52 for rotation therewith on the opposite side of the support 46 from the pulley gear 50. A motor 58 is attached to a bracket 60 by means of suitable bolts 62. The support 60 is attached to the side of the support 46 by means of suitable bolts 64. A pulley gear 66 is fastened to the outer end of the motor shaft 68 for rotation therewith. A gearbelt 70 passes around the pulley gears 56 and 66 so as to place these two pulley gears in driving relation with each other. Assuming that the length of the table is the "X" direction, then the motor 58 can also be referred to as the "X" motor. A cross member 72 extends from the side support 46 to the side support 48 for a purpose which will hereinafter appear.

At the left hand, or forward, end of the side support 46, a support cylinder 74 is attached by means of a bolt 76. A smaller cylinder or wheel 78 is mounted for free rotation on the end of a shaft 80 which is secured in the support cylinder 74. An O-ring 82 is suitably mounted in a groove (not shown) in the surface of the wheel 78. This O-ring 82 is adapted to ride in a groove or notch 84 which extends for the full length of the aluminum plates 38. Thus, when the carriage 10 moves in the "X" direction, the wheel 78 with its O-ring 82 will ride in the continuous groove 84 so as to keep the carriage 10 in continuous alignment with the "X" axis.

Referring now to FIGS. 12 to 15, a pen or stylus support block 86 is mounted for transverse sliding movement on a cylindrical rod 88 which extends across the upper side of the carriage 10 and which is secured by a suitable bolt 90 to the side support 48. The other end of the rod 88 is secured to the side support 46 by means of a similar bolt (not shown). A clamping plate 92 having a recessed portion 94 is clamped to the upper surface of the block 86 by means of bolts 94 and 96. The bolt 96 also attaches an L-shaped lever 98 to the upper surface of the clamping plate 92 for a purpose which will hereinafter appear. The clamping plate serves to clamp the lower portion of a transverse continuous gearbelt 100 to the block 86. The upper portion of the continuous gearbelt 100 is disposed directly beneath the cross member 72.

The left hand end (as it appears in FIG. 15) of the slideable block 86 is provided with a transverse recess 102 such that a pen support arm 104 can be received in this recess 102 below the clamping plate 92. Thus, the bolts 94 and 96 will pass through suitable holes in the clamping plate 92, in the pen support arm 104 and in the block 86 itself. The holes in the block 86 will, of course, be threaded. Therefore, when the bolts 94 and 96 are tightened, they will hold the clamping plate 92 and the pen support arm 104 in the position shown in FIG. 15. As indicated above, the bolt 96 also serves to hold the L-shaped lever arm 98 on the top of the clamping plate 92. The pen support arm 104 is provided with a cutout portion 106. A horizontal arm 108 extends laterally across the forward edge of the pen support arm 104 and is clamped thereto by means of bolt 110. The bolt 110 is received in a slot 112 on the horizontal arm 108 to permit lateral adjustment of the arm 108.

Figure 13:
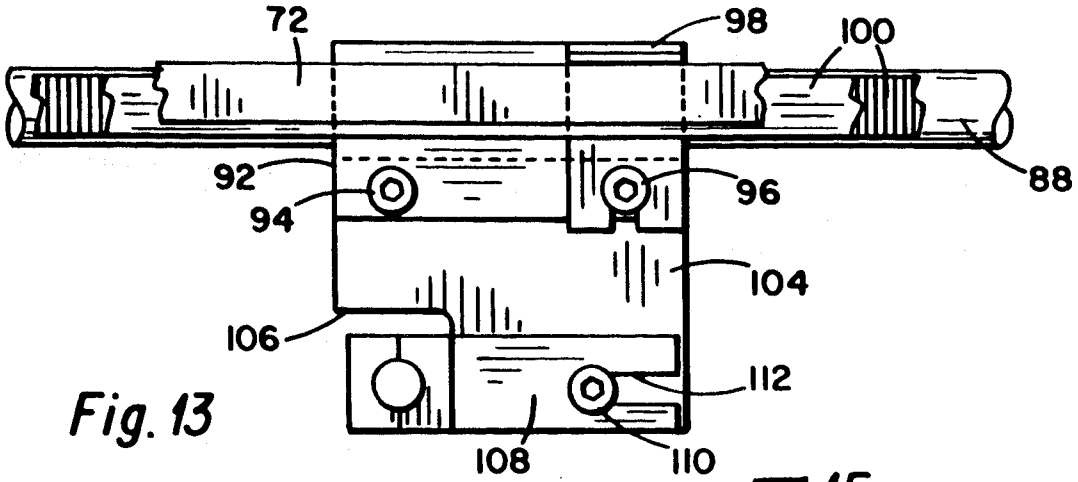
FIG. 13 is a plan view of the stylus or pen and associated mounting structure.
Figure 14:
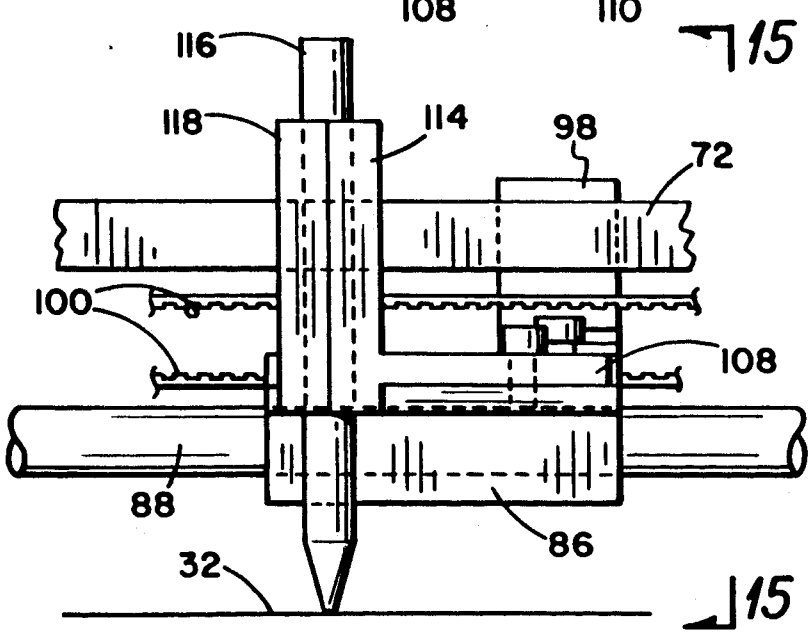
FIG. 14 is a front elevation taken from FIG. 13.
Figure 15:
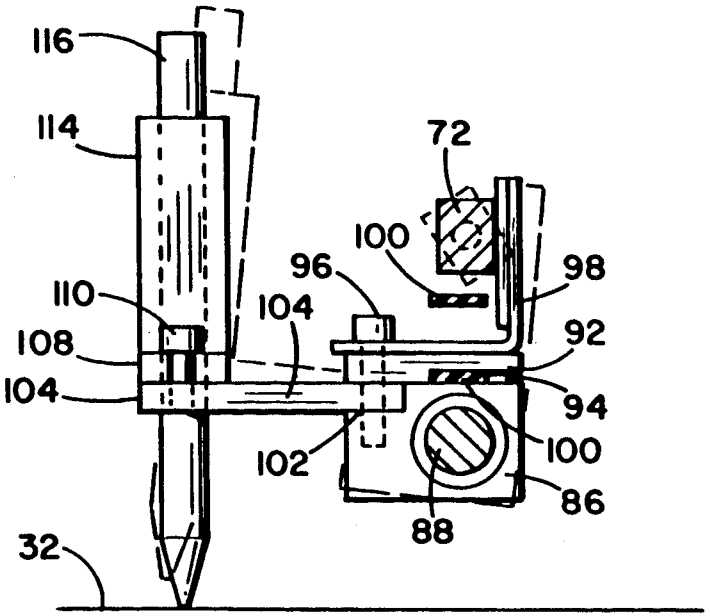
FIG. 15 is an elevation with same parts in section, taken along line 15—15 of FIG. 14 with the dotted lines representing the "pen up" position.

As it best appears in FIGS. 13 and 14, the left hand end of the horizontal arm 108 is provided with a vertical extension 114 which serves as one half of a pen or stylus holder for a pen or stylus 116. A separate vertical member 118 which is shaped in a complimentary manner with respect to the vertical portion 114, provides the other half of the pen holder. The vertical member 118 is secured to the vertical member 114 by means of suitable set screws (not shown) to clamp the pen 116 between the members 114 and 118. Due to the weight of the pen 116 and the support structure which extends to the left of the block 86 shown in FIG. 15, the L-shaped lever 98 will normally bear against the rear vertical edge of the transverse member 72. The pen will be resting against the surface of the table or on the sail cloth 32 supported on the table. However, if the support arm 72 were rotated (or pivoted) to the dotted line position shown in FIG. 15 in a manner to be described hereinafter, the lever 98 would be moved to the right and the entire pen assembly would be moved to the dotted line position shown in FIG. 15 to raise the pen 116 out of contact with the sail cloth 32.

Figure 10:
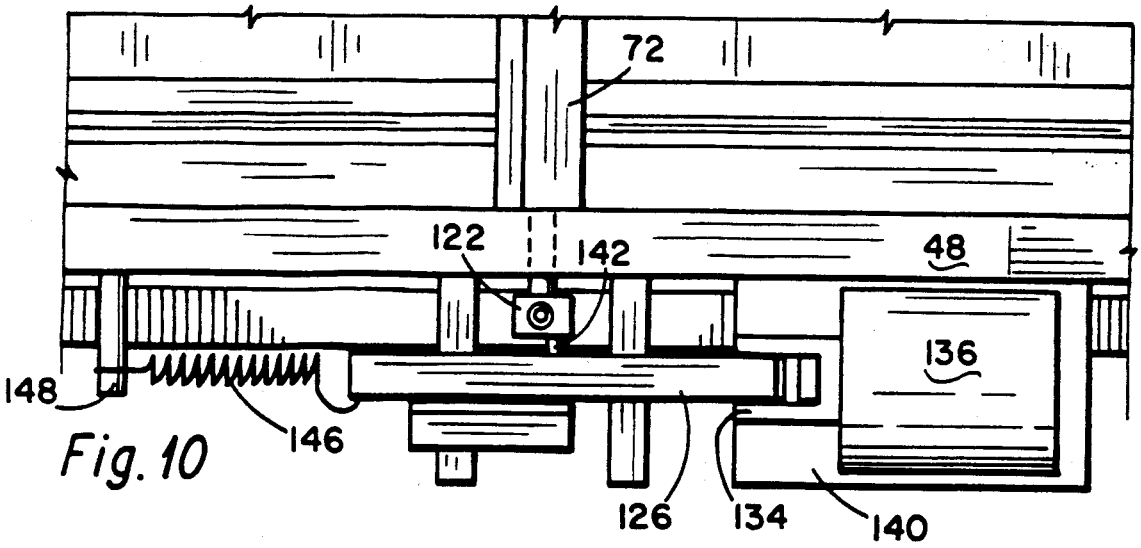
FIG. 10 is a plan view, on a slightly enlarged scale, of the solenoid and associated elements shown in FIG. 9 representing the "pen up" position.
Figure 11:
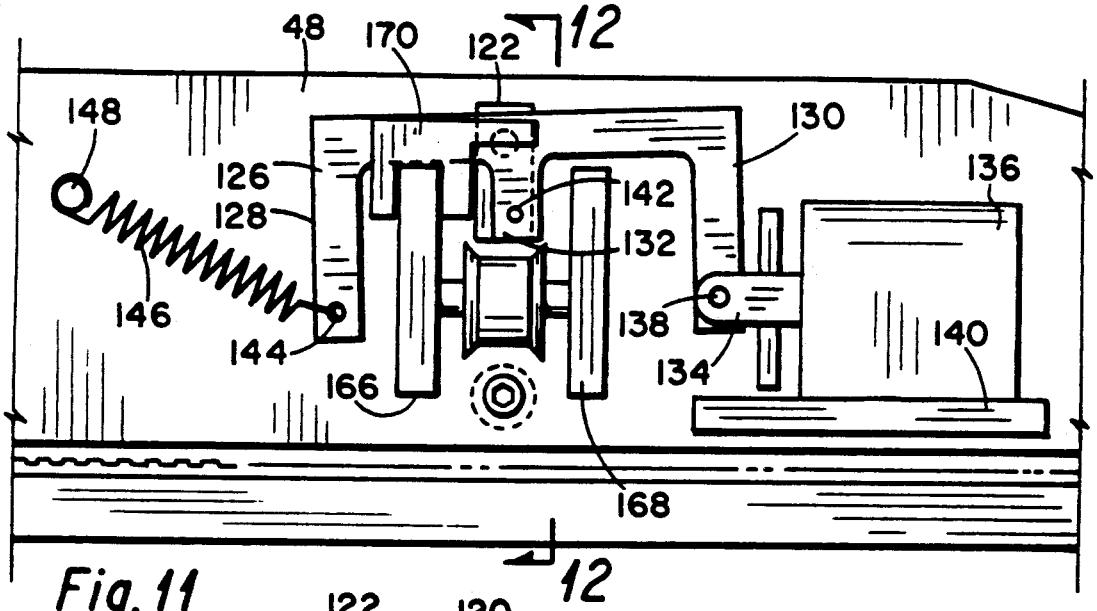
FIG. 11 is a front elevation of the components shown in FIG. 10.
Figure 12:
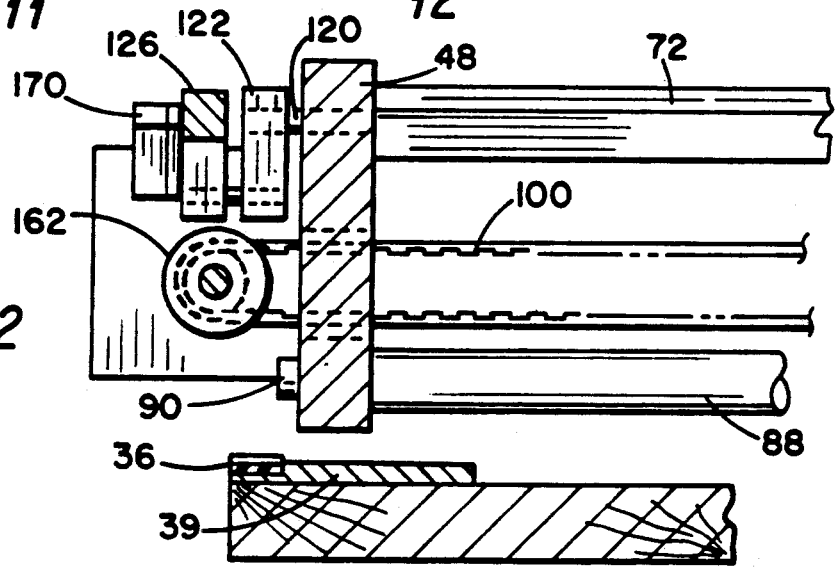
FIG. 12 is a sectional view taken along section line 12—12 of FIG. 11.

Turning now to a consideration of FIGS. 10, 11 and 12, the cross member 72 connects with a stub shaft 120 which extends through the side member 48 and which also connects with a rocker arm 122. The other end of the shaft 72 connects with a stub shaft 124 which passes through the side member 46 (see FIG. 5). The rocker arm 122 is secured to the stub shaft 120 such that rotation, or pivoting, of the rocker arm 122 will cause rotation or pivoting of the cross member 72. A yoke 126 is positioned outboard of the rocker arm 122. The yoke 126 is provided with two outer legs 128 and 130 and an intermediate shorter leg 132. The lower end of the leg 130 is pivotally connected to the outer end of an armature 134 of a solenoid 136 by means of a pin 138. The armature is mounted on a bracket 140 which is attached to the side support 48. The center leg 132 of the yoke 126 is provided with a pin 142 which extends into a suitable hole in the rocker arm 122. The vertical leg 128 is provided with a hole 144 at the lower end thereof. The hole 144 is adapted to receive the end of a coiled spring 146. The other end of the coiled spring passes around a pin 148 which is received in a suitable hole in the side member 48.

FIGS. 8 and 9 represent the "pen up" position when the solenoid 136 is de-energized. When the solenoid 136 is energized, the armature 134 will be moved towards the right (from the position shown in FIG. 8 to the position shown in FIG. 11). This action will draw the yoke 126 towards the right against the action of the spring 146. At the same time, the pin 142 will cause the rocker arm 122 to pivot in a counterclockwise direction in relation to FIG. 11, or clockwise with respect to FIG. 15. This action of the rocker arm will therefore pivot or turn the shaft 72 from the dotted line position to the solid line position shown in FIG. 15 and, therefore, the pen or stylus will now be in the "pen down" position.

Turning now to FIG. 5, the "Y" motor 150 is mounted on a vertical bracket 152 by means of bolts 154. The bracket 152 is mounted to the side member 46 by means of bolts 156. A pulley wheel 158 is secured to the outer end of the motor shaft 160 for the motor 150 and the gearbelt 100 passes around the gear pulley 158. The other end of the gearbelt 100 (see now FIG. 8) passes around a gear pulley 162 supported on a shaft 164. The shaft 164 is journaled for rotation in a pair of vertical plates 166 and 168 which are attached to the side of support member 48. A clamp 170 is secured to the top of the vertical support 166 to hold the yoke 126 in position adjacent the rocker arm 122.

The forward end of the support 48 is provided with a solid cylindrical member 172, and a wheel 174 is rotatably mounted on a shaft 176 which is received in the cylindrical member 172. The wheel 174 rides directly against the surface of the table 30. The aluminum strips 39 on the front side edge of the table 30 are narrower than the strips 38 and are not provided with the V-groove 84.

The two motors 58 and 150 and the solenoid 136 connect with the controller 16 by means of suitable wires or leads 180 and 182 shown in FIG. 3. These power leads will be sufficiently long to permit the carriage 10 to travel the full length of the table 30. The manner in which these leads 180 and 182 are connected to the power controller 16 is not part of the present invention. By virtue of the components shown in FIG. 1 and the program which is on the disk 18, the circuit will provide a series of pulses to the "X" motor 58, to the "Y" motor 115 and to the solenoid 136. The number of pulses provided to each motor or solenoid will be determined by the shape and location of the triangular piece to be traced on the sail cloth 32. If, for example, it is desired to position the pen six feet from the left hand end of the table 30 and one inch in from the lower or forward side edge of the sail cloth 32, then an exact predetermined number of pulses will be supplied to the "X" motor, which is in the nature of a stepping motor, to turn the shaft 52 and the gears 50 and 54 an exact number of revolutions or parts of revolutions so that the gears will travel along the belts 36 until the pen is positioned precisely six feet from the left hand end of the table 30; at the same time, the "Y" motor, which is similar to the "X" motor, will be fed a predetermined number of pulses to position the pen 116 exactly one inch in from the forward side edge of the sail cloth 32. At this time, a pulse will be fed to the solenoid 132 so as to actuate the same and bring the pen to the "pen down" position. The next series of pulses fed to the "X" and "Y" motors simultaneously will cause the pen to trace the desired patterns, such as patterns 184, 186 and 188 on the sail cloth 32. At the completion of each tracing, another pulse will be fed to the solenoid 136 to de-energize the same and bring the pen to the "pen up" position. Another series of pulses to the "X" and "Y" motors will bring the pen to the proper position to begin the next trace. The carriage 10 has sufficient weight to cause the gears 52 and 54 to mesh properly with the teeth on the gear strips 36. Movement of the carriage 10 will be fast and accurate. The pliancy of the neoprene gearbelt is such that backlash and noise is automatically eliminated as compared to typical rack-and-pinion drives made of metal components. Periodic adjustment for backlash is unnecessary due to the lack of wear on the belt under the force of contact.

Although the element 116 has been described herein as a "pen", it should be understood that this pen could be replaced with a pencil or other suitable stylus for marking a sail section of the sail cloth 32; furthermore, the stylus could be made capable of scoring or cutting instead of, or in addition to, merely marking on the sail cloth. Thus, where the word "stylus" appears in the claims, it should be understood that this term should be construed to include marking, scoring or cutting devices.

Whereas the present invention has been described in particular relation to the drawings attached hereto, it should be understood that other and further modifications, apart from those shown or suggested herein, may be made within the spirit and scope of this invention.

What is claimed is:

1. A device for marking lines on a piece of sail cloth for cutting out sections therefrom for making a sail, comprising an elongated and horizontally extending table for supporting a length of sail cloth thereon and being wider than the width of the sail cloth, a continuous strip of gearbelt material extending along each side edge of the table whereby the strips of gearbelt material are parallel to each other and to the longitudinal axis of the table, each strip of gearbelt material being pliant and being provided with internal reinforcements to prevent substantial longitudinal stretching thereof, the upper portion of each strip of gearbelt material being provided with uniformly spaced gear teeth for the length of each strip, a longitudinally moveable carriage mounted on the table, a transverse rotatable shaft mounted in the carriage, a pair of gears mounted adjacent the ends of the shaft for rotation therewith, each gear being adapted to mesh with a gearbelt strip such that a substantial portion of the weight of the carriage is exerted against the gearbelt strips through the gears, a first motor mounted on the carriage for rotating the shaft in response to a first series of signals received from a sail plotting program whereby the carriage can be positioned at a precise position along the length of the table, a stylus mounting means supported on the carriage for transverse sliding movement across the width of the sail cloth, a second motor mounted on the carriage and responsive to a second series of signals from the sail plotting program to move the stylus mounting means transversely along the carriage so as to position the stylus mounting means in a precise transverse position, a stylus carried by the stylus mounting means and adapted to bear against the upper surface of the sail cloth, and a stylus control means operatively associated with the stylus for lifting and lowering the stylus in relation to the sail cloth in response to a third series of signals from the sail plotting program.

2. A device as set forth in claim 1 wherein the stylus mounting means includes a cylindrical rod extending transversely across the carriage and a block mounted for transverse sliding movement on the rod, a pen support arm connected to the block, the stylus being supported by the pen arm; and a stylus control means comprising a solenoid mounted on the carriage for pivoting the block relative to the cylindrical rod in response to the third series of signals.

3. A device as set forth in claim 2 wherein said stylus control means further includes a pivotal transverse cross member extending across the carriage and having a transverse flat edge extending along the transverse cross member, an L-shaped bracket attached to the block and having an arm thereof adapted to bear against the flat surface of the transverse cross member, the cross member being provided with a stub shaft which connects with a rocker arm, the solenoid having a moveable armature which is moveable in response to the third series of signals, a yoke pivotally connected to the outer end of the armature and the outer end of the rocker arm whereby actuation of the solenoid will cause movement of the armature, the yoke, the rocker arm, pivoting of the cross member and ultimately pivoting of the block through the L-shaped bracket.

4. A device as set forth in claim 1 wherein the table is provided with metallic strips extending along the side edge of the table and wherein the strips of gearbelt material are mounted in recesses in the metallic strips, the metallic strips extending along one side of the table being provided with a continuous longitudinal notch, a wheel rotatably supported on the carriage, the wheel being provided with an O-ring adapted to ride in the notch.

5. A device as set forth in claim 4 wherein the carriage is provided with a second rotatable wheel located on the side of the carriage opposite from the first mentioned wheel, the second wheel being adapted to ride on the table.

* * * * *